US005531622A

United States Patent [19]

Nealy

[11] Patent Number: 5,531,622

[45] Date of Patent: Jul. 2, 1996

[54] QUICK DISCONNECT LEASH FOR SURFBOARD AND THE LIKE

[76] Inventor: Robert B. Nealy, P.O. Box 3154, San Clemente, Calif. 92672

[21] Appl. No.: 404,730

[22] Filed: Mar. 15, 1995

[51] Int. Cl.[6] ..... B63H 21/28

[52] U.S. Cl. ..... 441/75

[58] Field of Search ..... 441/65, 74, 75, 441/106, 108; 114/39.2; 24/542, 535, 536, 530, 520, 517, 513, 472, 474, 466, 467, 459, 455, 163 R

[56] References Cited

U.S. PATENT DOCUMENTS

| | | | |
|---|---|---|---|
| 4,041,562 | 8/1977 | Nealy | 441/75 |
| 4,234,990 | 11/1980 | Colburn | 441/75 |
| 4,555,234 | 11/1985 | Kent | 441/108 |
| 5,125,859 | 6/1992 | Spurgeon | 441/75 |
| 5,378,181 | 1/1995 | Sewell | 441/75 |

*Primary Examiner*—Stephen Avila
*Attorney, Agent, or Firm*—John E. Vanderburgh

[57] ABSTRACT

A quick disconnect leash for a surfboard or the like consists of a resilient cord affixed at one end to an object such as a surfboard and a securing strap attached to the opposite end for securing the leash to the ankle or waist of a user. The securing strap is closed by a quick release mechanism consisting of a fastener having opposed locking members for securing the ends of the strap and a quick release assembly for rapidly and conveniently releasing the fastener to free the ends of the strap. The quick release mechanism consists of a connector for acting on the fastener and a upstanding pull for actuating the connector. Preferably the fastener is of the side release type consisting of a housing and clip which is received in the housing to lock the two members together which is released by. The fastener is released by pulling the pull to cause the connector to unlock the clip from the housing. The pull should be of sufficient size to be readily grasped, even under emergency conditions. The ring is of sufficient stiffness to carry the pull in the generally upright position, while at the same time is sufficiently resilient so that the pull can be readily moved aside in the event of contact with another object so that the fastener is not accidently released.

2 Claims, 2 Drawing Sheets

FIG. 1
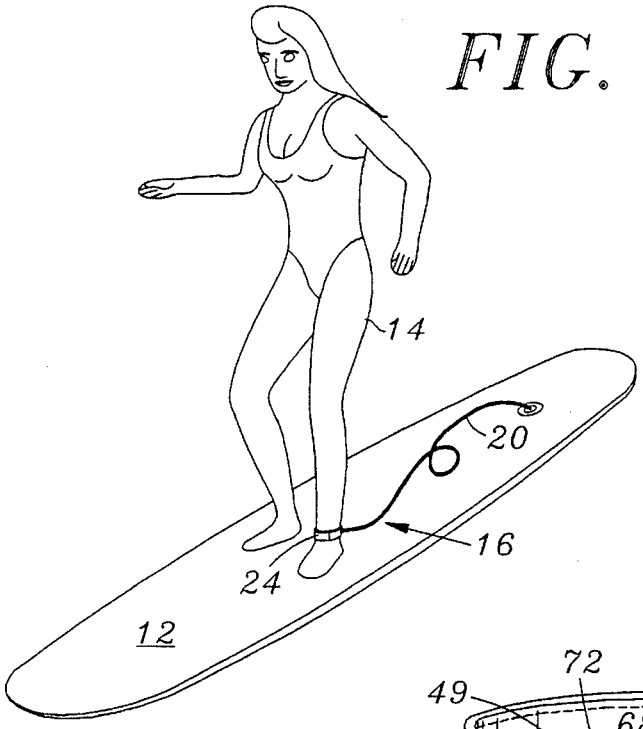
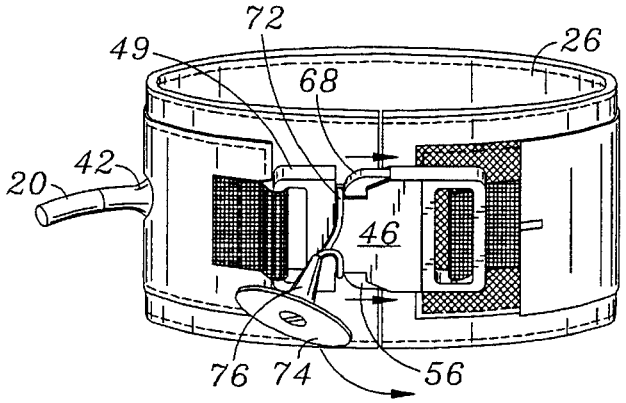
FIG. 3
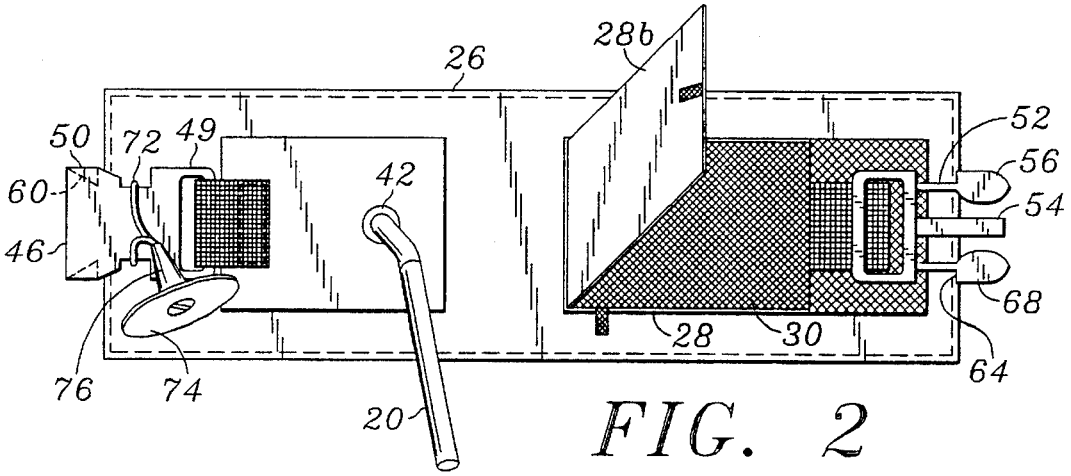
FIG. 2

QUICK DISCONNECT LEASH FOR SURFBOARD AND THE LIKE

FIELD OF THE INVENTION

This invention relates to leashes and securing straps and more particularly to quick release fasteners for such leashes and straps.

BACKGROUND OF THE INVENTION

In the sport of surfboarding, the surfboard is normally connected to the ankle of the rider by a strap and leash which prevents the surfboard from being damaged or lost in the event the rider falls off of the surfboard. More recently, in the sport of snowboarding, similar leash devices, among other devices, have been used to connect the snowboard to the ankle of tile rider so that the snowboard does not continue down the slope in the event the rider should fall.

Disconnecting the ankle strap to release the leash from the rider can sometimes be difficult, particularly in cold weather or cold water. In addition, on occasion, it is essential to quickly free oneself from the board in order to avoid serious injury.

As mentioned, the leash is attached to the rider by means of an ankle or waist strap which is normally closed by means of hook and loop fabric such as Velcro fabric. The securing strap is then opened by grasping a tab and pulling back against the Velcro fabric to release the ends of the strap. Under the conditions where, for example, the rider is wearing gloves in the case of snowboarding or the user's hands are cold in the case of snowboarding or surfboarding in cold water, releasing the ankle strap or waist strap at best can be difficult and essentially impossible under emergency conditions.

SUMMARY OF THE INVENTION

In accordance with the present invention, there is provided a device for easily and quickly releasing the end or ends of a leash or strap. The device of the present invention can be readily operated under emergency or adverse conditions to quickly release a strap or leash.

In more detail, the fastener of the present invention comprises a side release fastener consisting of a clip and a housing open at one end for receiving the clip. The clip and housing are secured to the opposing ends of a strap or straps to be secured to one another. The side walls of the housing adjacent to the open end are biased inwardly away from the open end and define camming surfaces. The medial portions of the sidewalls are provided with elongated openings. The clip is provided with a pair of extending elongated resilient prongs which are received by and locked in the housing. The end portion of each prong is enlarged and an outwardly extending locking shoulder is formed at the juncture of the enlarged tip portion and the body of the prong. When the clip is inserted in the housing, the enlarged portions of the prong contact the camming surfaces of the housing and urge the prongs inwardly toward each other. Upon insertion of the clip, the locking shoulders of the prongs become aligned with the open portion of the sidewall and the prongs spring back to their normal position urging the sides of the enlarged tipped portions through the elongated sidewall openings. The clip is prevented from retracting from the housing by the shoulder acting against the edge of the sidewall opening. The clip is released from the housing by squeezing the extending portions of the prongs together to move the shoulder out of alignment with the end of the sidewall opening of the housing. The clip can then be removed from the housing to release the ends of the strap.

The quick release feature is provided by an upstanding pull and ring assembly which carries an extending resilient loop which surrounds the housing of the fastener. The diameter of the loop is less than the distance between the outside surfaces of the prongs at their widest point. The pull should be of sufficient size to be readily grasped, even under emergency conditions. The ring is of sufficient stiffness to carry the pull in the generally upright position, while at the same time is sufficiently resilient so that the pull can be readily moved aside in the event of contact with another object so that the fastener is not accidently released.

The mechanism is operated by actuating the pull to cause the ring to slide along the housing and over the outer surfaces of the prongs when the clip is secured in the housing. The ring acts against the sides of the prongs to urge them inwardly causing the prong shoulders to become misaligned with the ends of the sidewall openings of the housing to permit the clip to be removed from the housing. In addition to urging the resilient prongs toward each other to release the shoulders, the pulling action also forces the clip out of the housing which further aids in the releasing action.

While the invention will be illustrated in connection with a surfboard leash, it will be understood that it may be used in any application to secure the ends of belts, straps, ties, and the like, where quick and convenient release of the straps is desired. For example, the quick release fasteners of the invention may also be used on strapping for back packs, securing straps for snowboard leashes and skis and for quick release of scuba diving equipment.

The invention will be more readily understood from the following description of a preferred embodiment of the invention taken in conjunction with the drawings.

BRIEF DESCRIPTION OF THE DRAWINGS

FIG. 1 is a perspective view of a surfboard leash designed in accordance with the invention in use on a surfboard;

FIG. 2 is a side view of the ankle strap of FIG. 2 in the fully opened position with the quick disconnect fastener released; and FIG. 3 is a side view of the ankle strap of FIG. 2 with the ends secured by the quick release fastener.

DESCRIPTION OF THE PREFERRED EMBODIMENT

Figure 4:
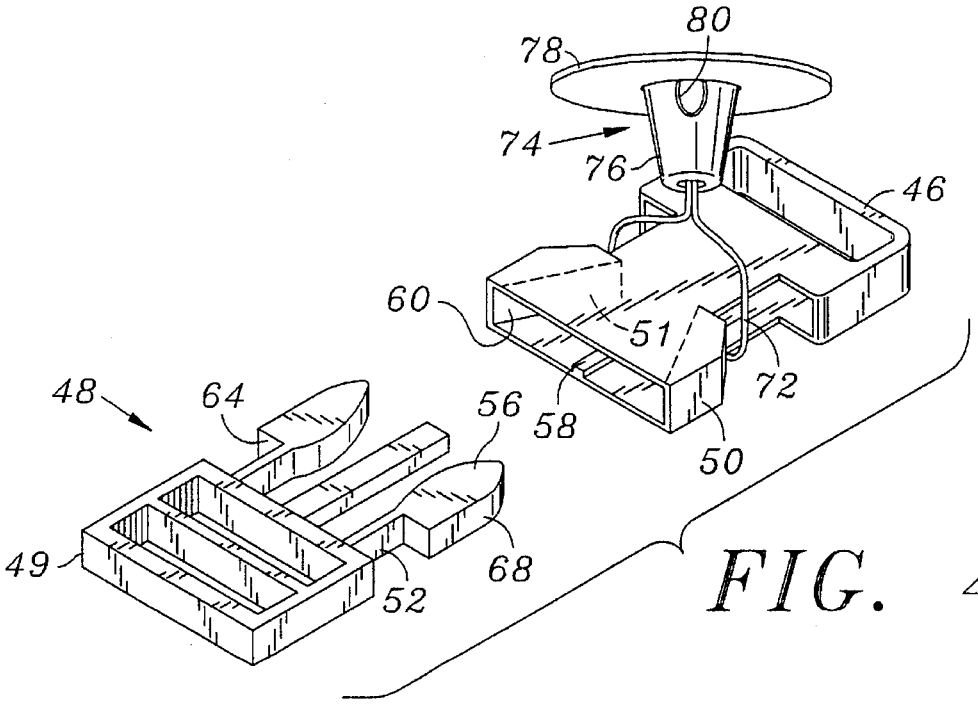
FIG. 4 is a perspective view of the quick release fastener of the present invention.
Figure 5:
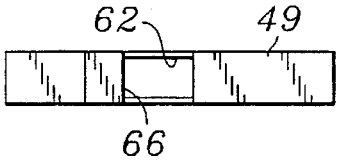
FIG. 5 is a side view of the fastener housing.
Figure 6:
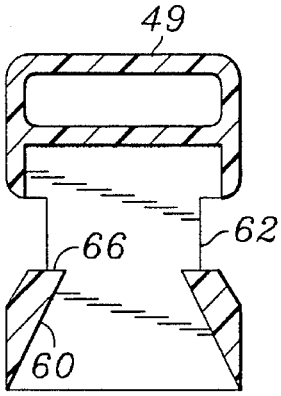
FIG. 6 is a top sectional view of the housing of FIG. 5.

Referring to the drawings, and FIG. 1 in particular, a surfboard 12 having a surfer 14 thereon is connected to the surfer by the surfboard ankle leash 16 which comprises a length of resilient cord 20 which is attached at one to the a surfboard 12 and at its opposite end to an ankle strap 24 worn by the surfer 14. Attachment of the cord to the surfboard 12 is accomplished by any suitable anchor means, such as, for example, a flathead anchor as described in U.S. Pat. No. 5,137,483 or U.S. Pat. No. 5,338,237. The resilient cord 20 may be formed of any resilient high strength material, such as for example polypropylene or nylon.

As most clearly shown in FIGS. 2 and 3, the ankle strap 24 consists of a length of high strength fabric 25 such as woven nylon which overlies a cushioning layer 26 of foam material. A length of Velcro hook material 28 overlies one end of the ankle strap 24. The hook material 28 is secured to the ankle strap 24 at one end portion 28*a* with the opposite end portion defining a flap 28*b* that folds back on the end portion 28*a*. A strip of Velcro loop material 30 is disposed between the flap 28*b* and the secured portion 28*a* of the Velcro hook material 30. One end of the Velcro loop material 30 extends beyond the end of the ankle strap 24. The Velcro loop strip 30 can be positioned on the length of Velcro hook material 26 so that the end extends more or less beyond the end of the ankle strap 24 to adjust the circumference of the ankle strap 24. Tabs 32 on the strip of Velcro loop material 30 and on the flap 28*b* of Velcro hook material are used to detach the loop strip 30 and the flap 28*b* for adjusting the length of the strap 24. The resilient cord 20 is attached to the ankle strap 24 by a mount 42 having a base (not shown) which lies between the length of fabric 25 and the cushioning material 26. The ankle strap 24 is secured about the ankle of the surfer 14 and the ends fastened by a quick release assembly 40 designed in accordance with the invention. As most clearly in FIGS. 2, 3 and 4, the quick release assembly 40 comprises a side release fastener 44 consisting of a housing 46 attached to one end of the ankle strap 24 and a clip 48 attached to the opposite end of the ankle strap 24. In the embodiment illustrated, the housing 46 is attached directly to the length of fabric 25 by means of a loop sewn onto the fabric 25. The clip 48 is similarly attached to the extending end of the strip of Velcro loop material 30 by a loop sewn onto the strip of loop material 30.

As most clearly shown in FIG. 4, the clip 48 comprises a buckle portion 49 from which extend a pair of resilient extending prongs 52 and a central guide 54 extending between the resilient prongs 52. The extending ends 56 of the prongs 52 are enlarged and the juncture of the enlarged ends and the body of the prong defines a shoulder 64. The housing 46 includes top, side and bottom walls which define an interior for receiving the prongs 52 and the guide 54 of the clip 48. One end of the housing 46 includes an enlarged end portion 50 having an open mouth 51 while the opposite end defines a buckle 49 for attachment to the ankle strap 24. A raised track 58 extends the length of the housing 46 along the bottom wall and is received in a corresponding groove in the guide 54 when the clip 48 is inserted in the housing 46 to prevent lateral movement of the clip 48 in the housing 46. Inwardly biased portions 60 of the interior surface of the sidewall adjacent the mouth 51 of the housing 46 serve to cam the enlarged ends 56 of the prongs 52 inwardly as the clip 48 is inserted. An opening 62 extends along the medial portion of each sidewall of the housing 46 between the open mouth 51 and the buckle portion 50. The edge of each of the openings 62 nearest the mouth 51 defines a stop 66 to engage a shoulder 64 of a prong 52 to prevent retraction of the clip 48 from the housing when the clip 48 is fully inserted into the housing 46. When the clip 48 is fully inserted into the housing 46 and the enlarged ends 56 of the prongs 52 are aligned with the sidewall openings 62, the prongs 52 spring apart and return to their normal position and the shoulder 64 engages the edge 66 of its respective opening 62 to lock the clip 48 into the housing 46. The outer surfaces 68 of the enlarged ends 56 of the prongs 52 extend through the sidewall openings 62. The clip 48 is released by applying force on the outer surfaces 68 of the enlarged ends 56 to urge the prongs 52 toward one another to disengage the shoulders 64 from the stops.

As is most clearly shown in FIGS. 3 and 4, a quick release assembly 70 consists of a resilient ring 72, which surrounds the housing 46 and a pull 74 which is affixed to the resilient ring 72. The diameter of the resilient ring 72 is less than the width of the housing 46 at the open mouth 51 but sufficiently large enough to permit the quick disconnect assembly 70 to move axially on the housing 46 between the buckle portion 50 and the enlarged mouth portion. The resilient ring 72 has sufficient stiffness so that when attached to the pull 74 it will maintain the pull 74 in a generally extending position with respect to the housing 46. Good results have been achieved utilizing nylon monofilament. In the embodiment illustrated the pull 74 consists of a generally tubular body 76 having on one end an enlarged disc shaped head 78 which has a central opening not shown) for communication with the bore of the body 76. An opening 80 is provided in the side of the body 76 adjacent the head 78 and the ring 72 and the pull 74 are attached by passing the free ends of the monofilament comprising the ring 72 through the bore and out the opening 80 to be looped around the body 76. The ends of the monofilament are then crimped together to form the ring 72 and secure the quick release assembly 70 on the housing 46.

In operation, the ends of the ankle strap 24 are secured by inserting the clip 48 into the housing 46 and forcing the prongs 52 toward one another by the camming action of the biased portions 60 of the sidewalls of the housing 46. When the enlarged ends 56 of the prongs 52 are aligned with the openings 62 in the sidewalls of the housing 46, the prongs 52 snap outwardly and are locked in position by the shoulders 64 and the stop 66 formed in the sidewall of the housing 46. The quick release assembly 70 slides axially on the housing 46 and rests between the ends 56 of the probes and the buckle portion of the housing 46. To release the ankle strap 24, the pull 74 is grasped and pulled axially causing the ring 72 to contact the ends 56 of the prongs 52 and to exert sufficient force to move the prongs 52 inwardly until the shoulders 64 are out of alignment with the stops 66. Continued pulling moves the clip 48 out of the housing 46, releasing the ends of the ankle strap 24.

Having described the invention, I claim:

1. A fastener for securing the ends of straps, said fastener comprising a side release fastener consisting of a housing and a clip, said housing having top, bottom and side walls defining an interior and an open mouth for receiving said clip, said clip including a pair of extending elongated resilient prongs each having an enlarged tip portion defining a generally rearwardly outwardly outer surface terminating in a shoulder at the juncture of said prong and said enlarged tip portion, an elongated opening medially disposed in each sidewall of said housing through which extends the outer surface of said enlarged tip portion of each prong when said clip is fully received in said housing, a stop being formed by each said sidewall at the edge of each elongated opening adjacent said open mouth being aligned with said shoulder of said prongs to lock said clip in said housing, quick release means cooperating with said fastener to release said clip from said housing, said quick release means including a pull and a connector, said connector of said quick release means consisting of an extending resilient loop surrounding said housing, the diameter of said loop being less than the distance between the outer surfaces of the prongs when said clip is fully received in said housing.

2. A surfboard ankle leash comprising a length of resilient cord adapted at one end for attachment to a surfboard and having an ankle strap at its opposite end, said ankle strap having a fastener comprising a side release fastener consisting of a housing and a clip, said housing having top, bottom and side walls defining an interior and an open mouth for receiving said clip, said clip including a pair of extending elongated resilient prongs each having an enlarged tip portion defining a generally rearwardly outwardly outer surface terminating in a shoulder at the juncture of said prong and said enlarged tip portion, an elongated opening medially disposed in each sidewall of said housing through which extends the outer surface of an enlarged tip portion a prong when said clip is fully received in said housing, a stop being formed by each said sidewall at the edge of each elongated opening adjacent said open mouth being aligned with said shoulder of said prongs to lock said clip in said housing, quick release means cooperating with said fastener to release said clip from said housing, said quick release means including a pull and a connector, said connector of said quick release means consisting of an extending resilient loop surrounding said housing, the diameter of said loop being less than the distance between the outer surfaces of the prongs when said clip is fully received in said housing.

* * * * *